US010954455B1

(12) United States Patent
Eggert et al.

(10) Patent No.: US 10,954,455 B1
(45) Date of Patent: Mar. 23, 2021

(54) DESALTER CHEMICAL CONTROL SYSTEM

(71) Applicant: Multi-Chem Group, LLC, Houston, TX (US)

(72) Inventors: Harold James Eggert, Missouri City, TX (US); Kevin S. Solomon, Tomball, TX (US); Jamie Nicole McDaniels, Bellingham, WA (US)

(73) Assignee: Multi-Chem Group, LLC, Houston, TX (US)

( * ) Notice: Subject to any disclaimer, the term of this patent is extended or adjusted under 35 U.S.C. 154(b) by 0 days.

(21) Appl. No.: 16/559,357

(22) Filed: Sep. 3, 2019

(51) Int. Cl.
*C10G 33/08* (2006.01)
*C10G 33/04* (2006.01)
*C10G 31/08* (2006.01)

(52) U.S. Cl.
CPC ..... *C10G 33/08* (2013.01); *C10G 31/08* (2013.01); *C10G 33/04* (2013.01); *C10G 2300/206* (2013.01); *C10G 2300/40* (2013.01); *C10G 2300/805* (2013.01)

(58) Field of Classification Search
CPC ..... C10G 31/08; C10G 33/04; C10G 33/08; C10G 2300/40; C10G 2300/206; C10G 2300/805
See application file for complete search history.

(56) References Cited

U.S. PATENT DOCUMENTS 4,947,885 A 8/1990 Hart
5,650,484 A * 7/1997 Hawkins ..... C08J 3/248 528/481
5,746,908 A * 5/1998 Mitchell ..... C10G 31/08 208/188
9,181,499 B2 11/2015 Mason et al.
9,255,228 B2 2/2016 Prasad et al.
2002/0033356 A1 3/2002 Honda et al.
2011/0089082 A1 4/2011 Snawerdt
2011/0100877 A1 5/2011 Snawerdt
2015/0191659 A1* 7/2015 Anderson ..... C10G 21/28 204/168
2018/0119031 A1 5/2018 Haworth et al.
2018/0195010 A1 7/2018 Salu et al.
2018/0371876 A1* 12/2018 Lopez ..... C10G 33/08

OTHER PUBLICATIONS

Payne, L. (2014) "The Modern Industrial Workhorse: PID Controllers" available from https://www.techbriefs.com/component/content/article/tb/pub/features/articles/20013.*
AGAR Corporation, Process Measurement & Control Solutions.
GE Healthcare, Transducer Guide, LOGIQ Series.
International Search Report and Written Opinion for Application No. PCT/US2019/049389, dated May 29, 2020.

* cited by examiner

*Primary Examiner* — Brian A McCaig
(74) *Attorney, Agent, or Firm* — Tenley Krueger; C. Tumey Law Group PLLC

(57) ABSTRACT

A system may include: a crude oil desalter; one or more sample points fluidically coupled to the crude oil desalter; and one or more fluid characterization units coupled to each of the one or more sample points, the one or more fluid characterization units being operable to measure at least one of density or flow rate of fluid from the sample points.

10 Claims, 1 Drawing Sheet

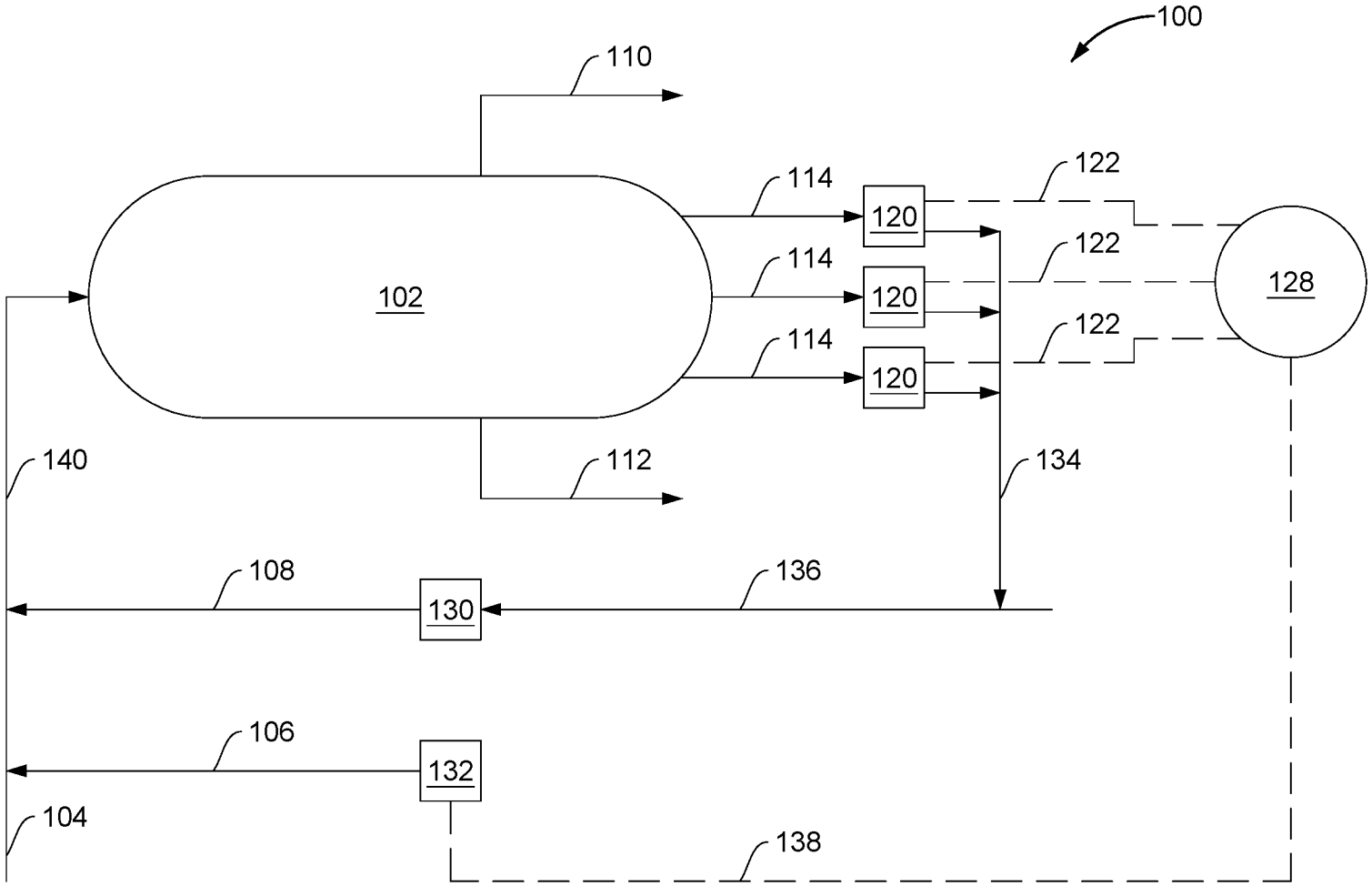
100
128
122
122
122
134
120
120
120
114
114
114
136
138
110
112
102
130
132
108
106
140
104

DESALTER CHEMICAL CONTROL SYSTEM

BACKGROUND

Crude oils are typically emulsions of water in oil with dissolved species present in the water. Salt in crude oil is usually dissolved in connate water that is associated with the production of crude oil. Pipeline grade crude oil often contains a fraction of water with dissolved salts as well as crystalline salts therein that may cause problems in downstream refinery processes. Dissolved and crystalline salts may cause corrosion in downstream units, promote the hydrolysis of water to hydrogen chloride, promote fouling, promote plugging, cause catalyst degradation, and cause other process upsets. Crude oil entering a refinery typically passes through several treatment units to remove water, sludge, and other impurities before the oil is passed to distillation processes.

Crude oil from a tank farm may be treated by a desalter before entering the main refining processes. The desalting process generally involves diluting the incoming crude oil with a relatively salt free water source thereby lowering the salt concentration of the oil-water mixture. The oil-water mixture may contain a water phase an oil phase with emulsified water entrained therein. The oil-water mixture may be allowed to separate in a settling vessel and the resultant water may be drawn off and sent to wastewater treatment. The oil separated in the desalter may be sent to atmospheric distillation, for example. Oftentimes an electric field is induced in the oil-water mixture through an electric grid positioned within the settling vessel to promote coalescence of entrained water. The electrical field imposes an electrical charge on the water droplets entrained in the bulk crude oil phase. The water droplets may coalesce into larger droplets, which can settle by gravity to the bulk liquid water phase.

Crude oils often contain natural emulsifiers that may lead to a relatively stable emulsion that may be difficult to break due to kinetic stability. Thermal methods, mechanical methods, and electrical methods may not be sufficient to separate the entrained water to the degree required for refinery purposes. As such, a demulsifier may be added to the oil-water mixture before or during the oil-water mixture is introduces into the desalter to promote destabilization of the emulsion. The addition of demulsifier is often a manual operation made by adjusting a valve or regulating pump speed to control the flow rate of demulsifier added to the oil-water mixture. When too little demulsifier is added, the emulsion level in the desalter unit may increase causing oil under carry to wastewater treatment and/or water over carry to downstream processing units. When too much demulsifier is added, there may be an unnecessary increase in operating costs. During upset and excursion events operators typically increase the concentration of demulsifier to reduce or prevent over carry and under carry. However, the increased concentration is often kept for longer than necessary which may increase operational costs. As the desalter unit is of a fixed volume and the feed points, discharge points, and electric grid location are static, the desalting process is often optimized around level control. However, the level of the oil-water interface does not exist as a distinct point where oil and water stratify into distinct phases. Rather, there is a transition zone where the volume percentages of oil and water continuously change through the transition zone.

Conventional level controls have often assumed that there is a stratified layer of oil and water and ignored the role of the transition zone in the desalting process. There have been some improvements in internal level control system which utilize guided wave radar and sonar to detect emulsion level and concentrations of oil and water along the height of the desalter unit, however these methods have not taken samples directly from the settling vessel. Optical methods have also been used in the past. Optical methods rely on the disparate absorption of energy of water and oil to determine the ratio of oil to water from samples taken at various heights along the desalter. In optical methods, a sample is drawn from a point on the desalter and passed through an optical transmission section of pipe and the transmittance is correlated to a volume fraction of oil or water. The optical transmission section may be a material transparent to the wavelength of incident light such as plastic or glass. While optical methods may give more accurate assessments of emulsion level, there may be distinct disadvantages to optical methods of measuring emulsion level. For example, the transmittance may be affected by oil deposits in the optical transmission section which may affect the accuracy of the reading. Furthermore, the optical transmission section may require cleaning and other maintenance.

BRIEF DESCRIPTION OF THE DRAWINGS

These drawings illustrate certain aspects of some of the present disclosure and should not be used to limit or define the disclosure.

The FIGURE is a schematic illustration of a system for controlling chemical additive flow rates in crude oil desalter.

DETAILED DESCRIPTION

Disclosed herein are apparatus, systems, and methods for controlling chemical additive flow rates in crude oil desalter units. The apparatus, systems, and methods disclosed herein may utilize a densometer or mass flow meter to measure the density or mass of a sample of fluid taken from a desalter unit.

A desalter unit may include sample points along a vertical axis of the desalter unit where fluid samples may be withdrawn and measured by the densometer or mass flow meter. As mentioned above, the emulsion level within a crude oil desalter is typically not a present as clearly stratified layers but rather may be a continuous changing zone from water to oil. Measurements from mass flow or density can be correlated to the level of the emulsion within the desalter unit and can further be used to calculate the volume percent or mass percent of oil at a level in the desalter unit. A signal from the densometer or mass flow meter may be sent to a flow controller which may determine a flow rate of chemical additive appropriate to keep one or more process variables within an operational envelope. One process variable may be the location of the emulsion layer within the desalter unit. The flow controller may then send a signal to a chemical additive pump which may then regulate a flow of chemical additive.

The FIGURE illustrates a system 100 for controlling the flow rate of chemical additive to a crude oil desalter 102. As mentioned above, a goal of the crude oil desalter unit may be to remove salt from the connate water associated with the crude oil. In practice, this often includes adding additional water to the oil to dilute the concentration of salt. As illustrated in the FIGURE, crude oil stream 104 and water stream 108 may be contacted and mixed to provide the necessary dilution. Although not illustrated in the FIGURE, there may be a mixing valve or other mixing means disposed upstream of the mixing point between crude oil stream 104 and water stream 108. The mixing of the oil from crude oil stream 104 and water from water stream 108 may cause emulsification of the oil and water and a mixed oil-water stream 140 containing oil, water, and emulsified oil and water may enter an inlet of crude oil desalter 102. Additionally, chemical additive pump 132 may pump a chemical additive via chemical additive stream 106 to either crude oil stream 104 water stream 108 or mixed oil-water stream 140. The chemical additive may be any chemical additive suitable to treat or control or otherwise keep one or more process variables within an operational envelope. Some chemical additives may include, without limitation, demulsifiers such as epoxy resins, acid or base catalyzed phenol-formaldehyde resins, poly ethylenimines, polyamines, dendrimer, di-epoxides, or polyols, for example. There may be many other demulsifiers not specifically mentioned herein that would be suitable for use in the demulsifying application.

In crude oil desalter 102 the oil, water, and emulsified oil and water from mixed oil-water stream 140 may be allowed to stratify into oil and water phases. As discussed above, there exists a water level in the bottom of the crude oil desalter, an emulsion containing transition zone where the volume percentages of oil and water continuously changes in a vertical direction, and a level of oil on top of the transition zone. In a process upset or excursion event, the transition zone containing the emulsion rises or lowers within the crude oil desalter 102. A rising emulsion layer may cause over carry of water to downstream process units and a lowering emulsion layer may cause under carry to wastewater processing. As such, there exists an operational envelope of emulsion position within crude oil desalter 102 where there is separation of the emulsion layer to stratified water and oil layers that does not cause over carry or under carry. As illustrated in the FIGURE, the separated oil from mixed oil-water stream 140 may exit crude oil desalter 102 as oil stream 110. Oil stream 110 may be conveyed to downstream processes such as a second stage desalter unit or distillation, for example. The separated water from mixed oil-water stream 140 may exit crude oil desalter 102 as water stream 112. Water stream 112 may be conveyed to wastewater processing or other units configured to process the content of water stream 112.

Crude oil desalter 102 may include equipment to promote separation of the emulsified water droplets in the bulk emulsified layer. A first step in separation may include flocculation or aggregation of water droplets. Flocculation and aggregation may move the water droplets in the emulsion physically closer which may lead to the coalescence of the individual water drops to larger droplets. The coalesced droplets may fall out of the bulk emulsified layer by sedimentation and be incorporated into the bulk aqueous phase at the bottom of the crude oil desalter 102. Each of the processes described including flocculation, aggregation, coalescence, and sedimentation may be accelerated by equipment place within crude oil desalter 102 or as auxiliary equipment placed before or after crude oil desalter 102. Some exemplary equipment may include temperature control equipment such as heaters, shearing equipment including stirring and mixing mechanisms, filtration equipment, and electric field generators such as electrostatic grids. Although only some equipment is mentioned herein, the present disclosure should not be read to be limiting to any particular configuration of desalter as the principle of operation of the present disclosure may be applied to any desalter configuration.

Crude oil desalter 102 may include one or more sample points 114 so fluid samples can be drawn at different locations from crude oil desalter 102. The sample points 114 may be disposed on crude oil desalter 102 at any points, preferably at different vertical locations such that fluid samples can be drawn from different levels within any combination of water layer, emulsion layer, and oil layer. Although only three of the sample points 114 are illustrated in the FIGURE, any number of the sample points 114 may be disposed on crude oil desalter 102. Each of the sample points 114 may be placed to capture a desired fraction of fluid such as water, oil, or emulsion. In some examples, sample points 114 may be connected to internal equipment in the crude oil desalter 102 such as by try lines. In some examples, the sample points 114 may be connected through a shell of crude oil desalter 102 and be in direct fluid communication with fluids in crude oil desalter 102.

Each of the sample points 114 may be in fluid communication with fluids in crude oil desalter 102 and one or more fluid characterization units 120. Fluid characterization unit 120 may include a densometer or mass flow meter, for example, that analyzes fluids sampled from crude oil desalter 102 and returns a signal 122 corresponding to a measured value of the sampled fluid. In examples where the fluid characterization unit 120 is a densometer, the measured value may be density. In examples where the fluid characterization unit 120 is a mass flow meter, the measured value may be mass flow rate. In some examples, the mass flow meter may be a Coriolis meter. From the measured value from fluid characterization unit 120, the volume fraction of water or oil in the sampled fluid may be readily calculated. Alternatively and equivalently, the volume flow rate of water or oil may be calculated, mass fraction of water or oil may be calculated, or mass flow rate of water or oil may be calculated. Calculation of mass fractions of oil and/or water may be accomplished by comparing the measured value to a reference table or calibration curve, for example. Although not shown in the FIGURE, a density or mass flow rate of any of mixed oil-water stream 140, oil stream 110, or water stream 112 may additionally be measured. A signal 122 from the one or more fluid characterization units 120 may be sent to flow controller 128. Signal 122 may be any kind of signal transferred by any means such as a wireless signal, wired signal, for example. Signal 122 may contain a result of the measurement made by fluid characterization unit 120 such as a raw, unprocessed signal, or may contain the result of any of the calculations mentioned above. The sampled fluid from the one or more fluid characterization units 120 may transported via stream 134 to makeup water 136 to be returned to crude oil desalter 102.

Flow controller 128 may accept signal 122 as an input and output a control signal 138 to chemical additive pump 132 to control a pump speed of chemical additive pump 132, for example. Flow controller 128 may utilize a predictive model to determine an amount of chemical additive to add using chemical additive pump 132 to keep one or more process variables within an operational envelope. The predictive model may include functions to estimate the effect on the emulsion layer of adding a volume of a chemical additive to mixed oil-water stream 140. As discussed above, there may exist an operational envelope where the emulsion layer is positioned within crude oil desalter 102 such that water and oil are separated without overcarry or undercarry. A process variable may include minimum lower level of emulsion layer in crude oil desalter 102, maximum upper level of emulsion layer in crude oil desalter 102, minimum emulsion height, and maximum emulsion height, for example. In addition to or alternatively to control signal 138 being sent to chemical additive pump 132, a control signal may be sent to a valve which may regulate flow rate of chemical additive. In another example, there may be multiple chemical additive pumps which are fluidically connected to different chemical additives such that flow controller 128 may select one or more chemical additives to add to crude oil desalter 102. In some examples, flow controller 128 may include a three term controller such as a proportional-integral-derivative controller (PID controller). A setpoint of at least one of minimum lower level of emulsion layer, maximum upper level of emulsion layer, minimum emulsion height, and maximum emulsion height, may be selected and the PID controller may provide control signal 138 in response to signal 122.

In examples, a chemical additive may include any suitable chemical additive for causing a desired effect in the crude desalter 102. For example, chemical additive may include, but is not limited to, a primary emulsion breaker, an adjunct breaker, a solids wetting agent, an acidifying agent, an asphaltene stabilizer, a water clarifier and iron chelating agent, or any combinations thereof. The mass or volumetric flow rate for any of the chemical additives may be determined by flow controller 128 using any of the above mentioned methods. Additionally, there may be multiple pumps fluidically coupled to sources of chemical additives such as tanks or totes to provide any combination of chemical additives as determined by flow controller 128.

Accordingly, the present disclosure may provide methods, systems, and apparatus that may relate to controlling chemical additive flow rates in crude oil desalter units. The methods, systems, and apparatus may include any of the various features disclosed herein, including one or more of the following statements.

Statement 1. A system comprising: a crude oil desalter; one or more sample points fluidically coupled to the crude oil desalter; and one or more fluid characterization units coupled to each of the one or more sample points, the one or more fluid characterization units being operable to measure at least one of density or flow rate of fluid from the sample points.

Statement 2. The system of statement 1 wherein the one or more fluid characterization units comprise a mass flow meter, a densometer, or both.

Statement 3. The system of any of statements 1-2 wherein the one or more fluid characterization units comprise a Coriolis meter.

Statement 4. The system of any of statements 1-3 wherein the one or more fluid characterization units outputs a signal corresponding to at least one of volume flow rate of water, volume flow rate of water of oil, mass fraction of water, mass fraction of oil may be calculated, mass flow rate of water, or mass flow rate of oil.

Statement 5. The system of any of statements 1-4 further comprising a flow controller operable to take an input from the one or more fluid characterization units and output a control signal to a chemical additive pump fluidically connected to an inlet of the crude oil desalter.

Statement 6. The system of statement 5 wherein the flow controller is a PID controller wherein the PID controller accepts a setpoint of at least one of minimum lower level of emulsion layer, maximum upper level of emulsion layer, minimum emulsion height, and maximum emulsion height and outputs the control signal in based at least in part on the setpoint and the input from the one or more fluid characterization units.

Statement 7. The system of any of statements 1-6 further comprising a chemical additive pump fluidically coupled to a chemical additive and an inlet of the crude oil desalter, the chemical additive being selected from the group consisting of a primary emulsion breaker, an adjunct breaker, a solids wetting agent, an acidifying agent, an asphaltene stabilizer, a water clarifier and iron chelating agent, and combinations thereof.

Statement 8. A method comprising: obtaining a fluid sample from a crude oil desalter; measuring at least one of a density or a mass flow rate of the fluid sample; and adjusting a flow rate of a chemical additive into an inlet of the crude oil desalter based at least in part on the measured density and/or the measured mass flow rate.

Statement 9. The method of statement 8 wherein the step of measuring comprises measuring using a mass flow meter, a densometer, or both.

Statement 10. The method of any of statements 8-9 wherein the step of measuring comprises measuring mass flow rate using a Coriolis meter.

Statement 11. The method of any of statements 8-10 wherein the step of adjusting comprises generating a control signal from a flow controller and sending the control signal to a chemical additive pump, wherein the control signal causes the chemical additive pump to adjust the flow rate of a chemical additive.

Statement 12. The method of statement 11 wherein the flow controller takes as input the density, the mass flow rate, or both and outputs the control signal based at least in part on the density, the mass flow rate, or both.

Statement 13. The method of any of statements 11-12 wherein the flow controller is a PID controller, wherein the PID controller accepts a setpoint of at least one of minimum lower level of emulsion layer, maximum upper level of emulsion layer, minimum emulsion height, and maximum emulsion height, and wherein the PID outputs the control signal in based at least in part on the setpoint and the density, the mass flow rate, or both.

Statement 14. The method of any of statements 11-13 wherein the chemical additive is selected from the group consisting of a primary emulsion breaker, an adjunct breaker, a solids wetting agent, an acidifying agent, an asphaltene stabilizer, a water clarifier and iron chelating agent, and combinations thereof.

Statement 15. The method of any of statements 11-14 further comprising adjusting a flow rate of a chemical additive to a location upstream of the crude oil desalter based at least in part on the measured density or mass flow rate.

Statement 16. A method comprising: obtaining a fluid sample from a crude oil desalter; measuring at least one of a density or a mass flow rate of the fluid sample; and adjusting a flow rate of a chemical additive to a location upstream of the crude oil desalter based at least in part on the measured density or mass flow rate.

Statement 17. The method of statement 16 wherein the step of measuring comprises measuring using a mass flow meter, a densometer, or both.

Statement 18. The method of any of statements 16-17 wherein the step of adjusting comprises generating a control signal from a flow controller and sending the control signal to a chemical additive pump, wherein the control signal causes the chemical additive pump to adjust the flow rate of a chemical additive Statement 19. The method of any of statements 16-18 wherein the flow controller is a PID controller, wherein the PID controller accepts a setpoint and generates a control signal to a chemical additive pump upstream of the crude oil desalter based at least in part on the density, the mass flow rate, or both, and the setpoint.

Statement 20. The method of any of statements 16-19 wherein the chemical additive is selected from the group consisting of a primary emulsion breaker, an adjunct breaker, a solids wetting agent, an acidifying agent, an asphaltene stabilizer, a water clarifier and iron chelating agent, or any combinations thereof.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

What is claimed is:

1. A method comprising:

obtaining a fluid sample from a crude oil desalter;

measuring at least one of a density or a mass flow rate of the fluid sample; and adjusting a flow rate of a chemical additive into an inlet of the crude oil desalter based at least in part on the measured density and/or the measured mass flow rate, wherein the step of adjusting comprises generating a control signal from a PID flow controller and sending the control signal to a chemical additive pump, wherein the control signal causes the chemical additive pump to adjust the flow rate of a chemical additive, wherein the PID flow controller accepts a setpoint of at least one of minimum lower level of emulsion layer, maximum upper level of emulsion layer, minimum emulsion height, and maximum emulsion height, and wherein the PID flow controller outputs the control signal in based at least in part on the setpoint and the density, the mass flow rate, or both.

2. The method of claim 1 wherein the step of measuring comprises measuring using a mass flow meter, a densometer, or both.

3. The method of claim 1 wherein the step of measuring comprises measuring mass flow rate using a Coriolis meter.

4. The method of claim 1 wherein the PID flow controller takes as input the density, the mass flow rate, or both and outputs the control signal based at least in part on the density, the mass flow rate, or both.

5. The method of claim 1 wherein the chemical additive is selected from the group consisting of a primary emulsion breaker, an adjunct breaker, a solids wetting agent, an acidifying agent, an asphaltene stabilizer, a water clarifier and iron chelating agent, and combinations thereof.

6. The method of claim 1 further comprising adjusting a flow rate of a chemical additive to a location upstream of the crude oil desalter based at least in part on the measured density or mass flow rate.

7. A method comprising:

obtaining a fluid sample from a crude oil desalter;

measuring at least one of a density or a mass flow rate of the fluid sample;

adjusting a flow rate of a chemical additive to a location upstream of the crude oil desalter based at least in part on the measured density or mass flow rate; wherein the step of adjusting comprises generating a control signal from a flow controller and sending the control signal to a chemical additive pump, wherein the control signal causes the chemical additive pump to adjust the flow rate of the chemical additive, wherein the flow controller is a PID controller, wherein the PID controller accepts a setpoint of at least one of minimum lower level of emulsion layer, maximum upper level of emulsion layer, minimum emulsion height, and maximum emulsion height, and wherein the PID outputs the control signal in based at least in part on the setpoint and the density, the mass flow rate, or both.

8. The method of claim 7 wherein the step of measuring comprises measuring using a mass flow meter, a densometer, or both.

9. The method of claim 7 wherein the step of adjusting comprises generating a control signal from a flow controller and sending the control signal to a chemical additive pump, wherein the control signal causes the chemical additive pump to adjust the flow rate of a chemical additive.

10. The method of claim 7 wherein the chemical additive is selected from the group consisting of a primary emulsion breaker, an adjunct breaker, a solids wetting agent, an acidifying agent, an asphaltene stabilizer, a water clarifier and iron chelating agent, or any combinations thereof.

* * * * *